US009869470B1

(12) United States Patent
Chen

(10) Patent No.: US 9,869,470 B1
(45) Date of Patent: Jan. 16, 2018

(54) LIGHTER DEVICE WITH CLOSED FLAME SYSTEM

(71) Applicant: Amazing Buy Inc., Temple City, CA (US)

(72) Inventor: Feng F. Chen, Temple City, CA (US)

( * ) Notice: Subject to any disclaimer, the term of this patent is extended or adjusted under 35 U.S.C. 154(b) by 0 days.

(21) Appl. No.: 15/458,938

(22) Filed: Mar. 14, 2017

(51) Int. Cl.
*F23D 14/28* (2006.01)

(52) U.S. Cl.
CPC ..... *F23D 14/28* (2013.01)

(58) Field of Classification Search
CPC ..... F23D 14/20; F23D 14/32; A61M 15/06; A61M 11/048
See application file for complete search history.

(56) References Cited

U.S. PATENT DOCUMENTS 4,966,128 A * 10/1990 Wang ..... F23D 14/28 126/413

2004/0202978 A1* 10/2004 Wong ..... F23D 14/28 431/344

FOREIGN PATENT DOCUMENTS

FR 2411363 A2 * 7/1979 ..... F23D 14/28

* cited by examiner

*Primary Examiner* — Jason Lau
(74) *Attorney, Agent, or Firm* — CIONCA Law Group P.C.; Marin Cionca

(57) ABSTRACT

A lighter device having a torch integrated within a handle having a top handle end and a bottom handle end, the torch having a fuel tank, an ignition means, and an ignition actuating means; the lighter device further having a closed flame system having a base portion associated with the top handle end, a neck portion having a plurality of holes and configured to house and partially enclose a flame ignited by the torch, and an attachment portion; the base portion, the neck portion and the attachment portion being in communication and defining a hollow interior space, and thus supplying air flow to the flame by allowing the air flow into the hollow interior space from the plurality of holes.

17 Claims, 23 Drawing Sheets

LIGHTER DEVICE WITH CLOSED FLAME SYSTEM

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF INVENTION

1. Field of the Invention

The invention relates generally to accessories for use with smoke products and more specifically to lighter devices.

2. Description of the Related Art

Most users of *cannabis* products use blow torches in order to smoke marijuana and dab wax. However, the use of an open flame presents many safety hazards. At indoor trade shows, this can also be a problem, due to retailers and other exhibitors allowing the use of their torch products indoors in order to make a sale, despite regulations against indoor use of a torch with an open flame. Users may also hurt or burn themselves on a torch providing an open flame. However, the flame may not be fully enclosed to reduce the safety hazards, due to lack of air being supplied to the flame, and thus, the flame dying out. Therefore, there is a need for a solution to these problems.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a lighter device is provided, having a torch integrated within a handle having a top handle end and a bottom handle end, the torch comprising a fuel tank, an ignition means, and an ignition actuating means; the lighter device further having a closed flame system having a base portion associated with the top handle end, a neck portion having a plurality of holes and configured to house and partially enclose a flame ignited by the torch, and an attachment portion; the base portion, the neck portion and the attachment portion being in communication and defining a hollow interior space, and thus supplying air flow to the flame by allowing the air flow into the hollow interior space from the plurality of holes. Thus, an advantage is a torch for smoke products may be provided to a user having a sustained flame that is partially closed or contained, reducing the safety hazards of using a torch.

In another aspect, a closed flame system for housing and partially enclosing a flame is provided, having a base portion, a neck portion having a plurality of holes, and an attachment portion; the neck portion and the attachment portion being in communication and defining a hollow interior space, and thus supplying air flow to the flame by allowing the air flow into the hollow interior space from the plurality of holes. Thus, an advantage may be that the closed flame system may be used with any suitable lighter device for partially enclosing a flame to reduce safety hazards, and to supply air to the partially enclosed flame.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1A:
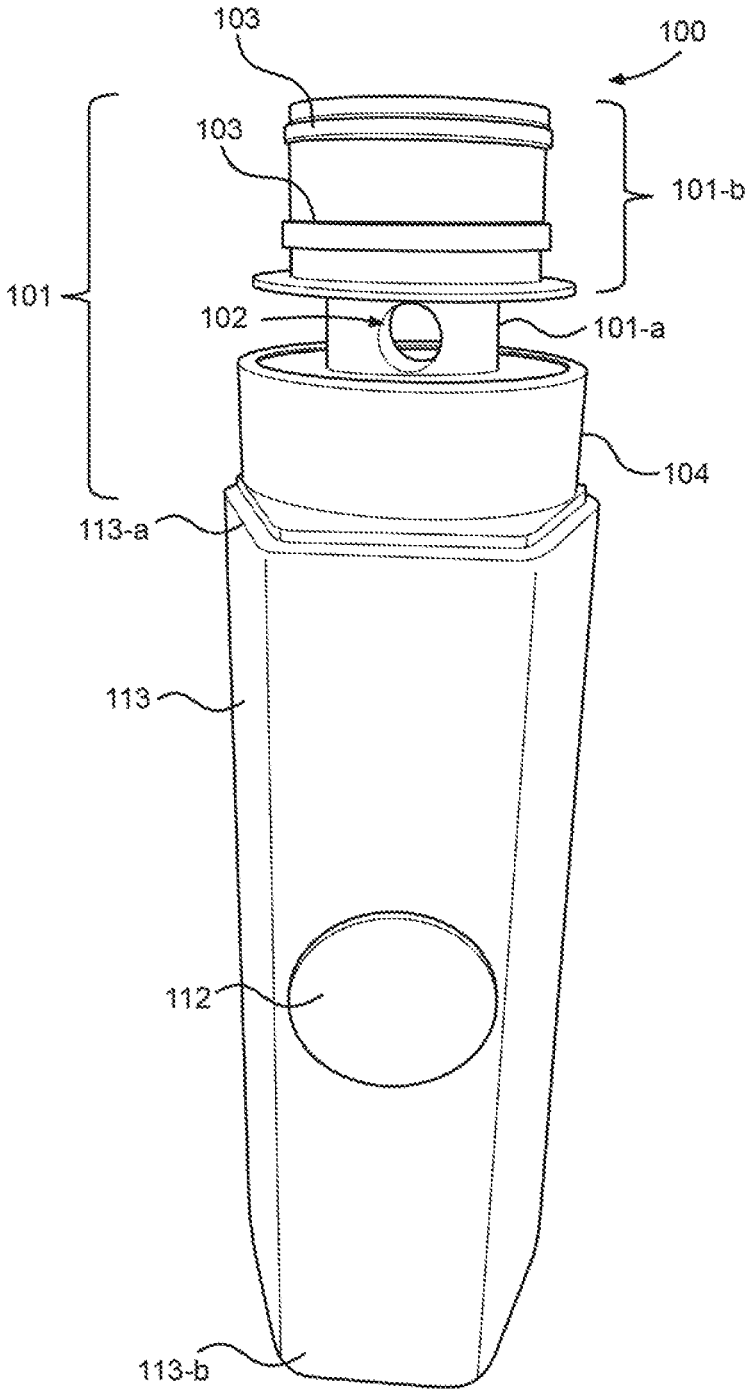
FIG. 1*a* shows the front view of a closed flame system lighter device for smoke products, shown in an unlit state, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

For the following description, it can be assumed that most correspondingly labeled elements across the figures (e.g., 101 and 201, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

Figures 10A, 10B:
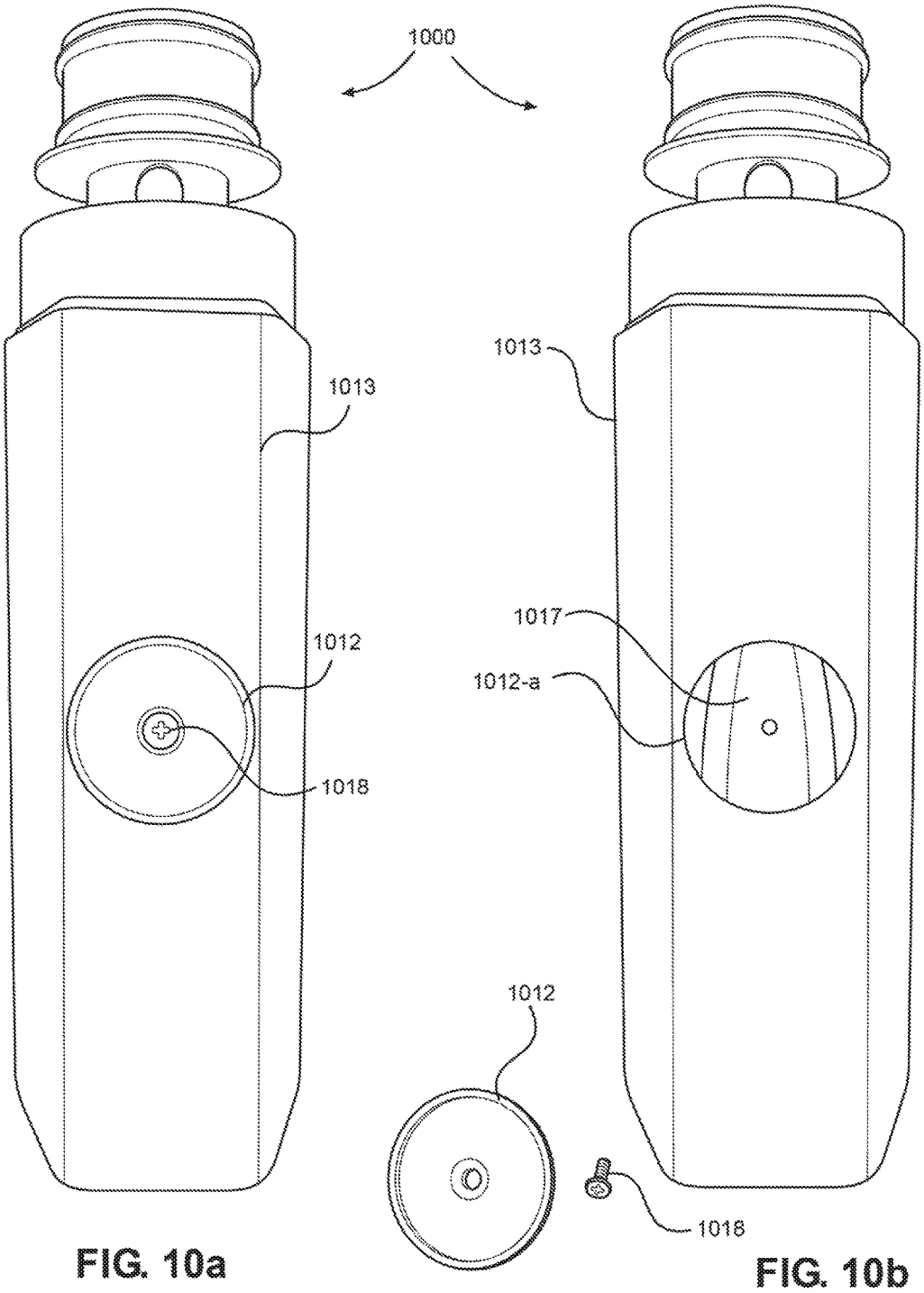
FIG. 10*a* shows the front view of the lighter device without a decorative element on the button, according to an aspect.
FIG. 10*b* shows the front view of the lighter device with the button removed, showing a fuel tank inside of the handle, according to an aspect.
Figure 11:
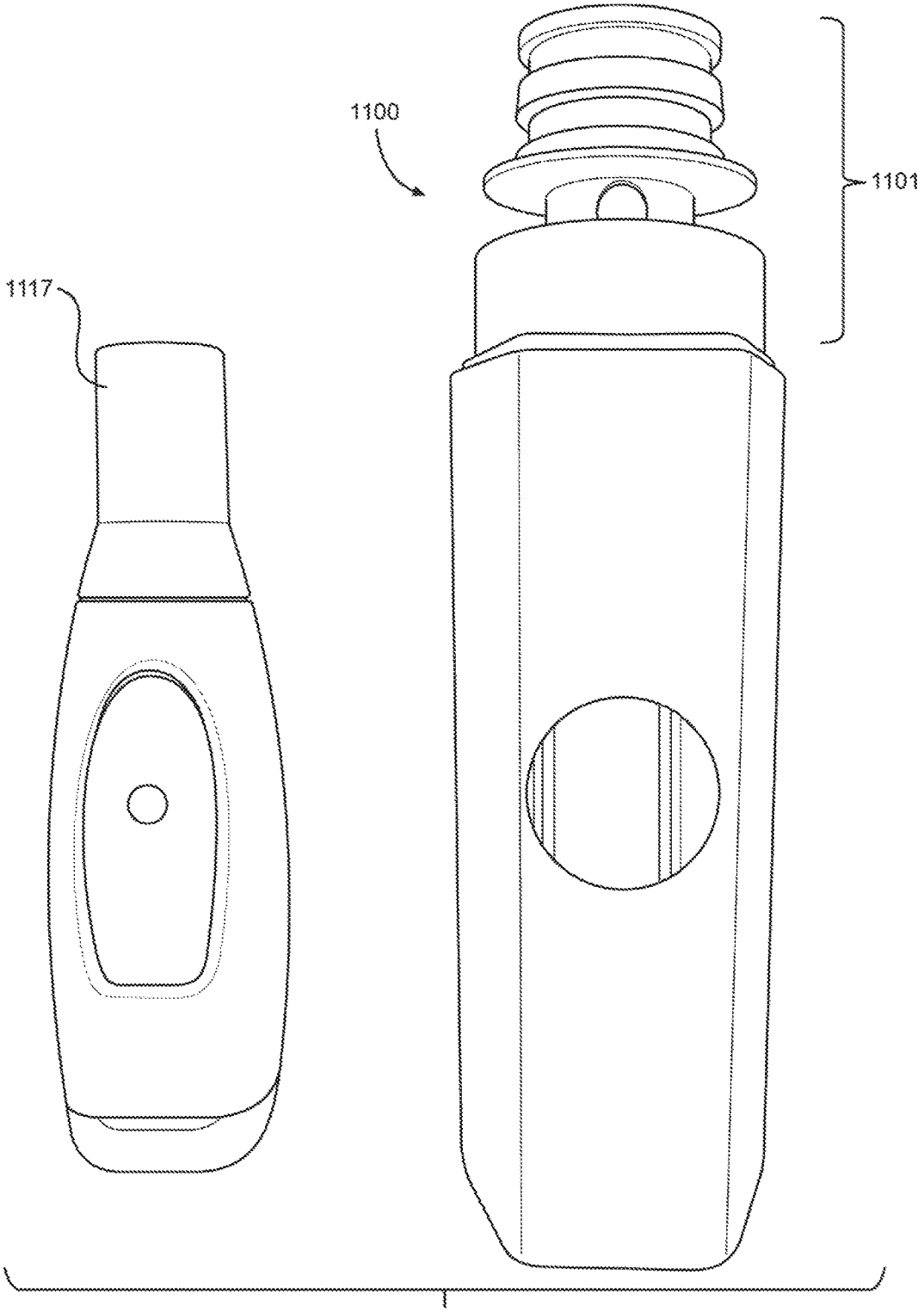
FIG. 11 shows the front view of the fuel tank removed from the lighter device, according to an aspect.

FIG. 1*a* shows the front view of a closed flame system lighter device ("closed flame system lighter," "lighter device," or "lighter") 100 for smoke products, shown in an unlit state, according to an aspect. The closed flame system lighter device 100 may be provided with a base or handle 113, which may also contain portions of the torch. The torch may include a fuel tank (as shown in FIGS. 10*b* and 11) and an ignition means (not shown), such as, for example, as in a cigarette lighter. The torch may, for example, be butane, and may be operated by a button 112, which may include a decorative element as shown. The actuation of the torch ignition may also be performed by any other suitable means. The fuel tank (as shown in FIG. 11) may, for example, be contained within the handle 113, and the button 112 may be integrated within the handle 113. The flame produced by the torch may also be controlled by a flame control knob (not shown), for example, such that the strength and size of the flame may be adjusted by the user.

Figure 1B:
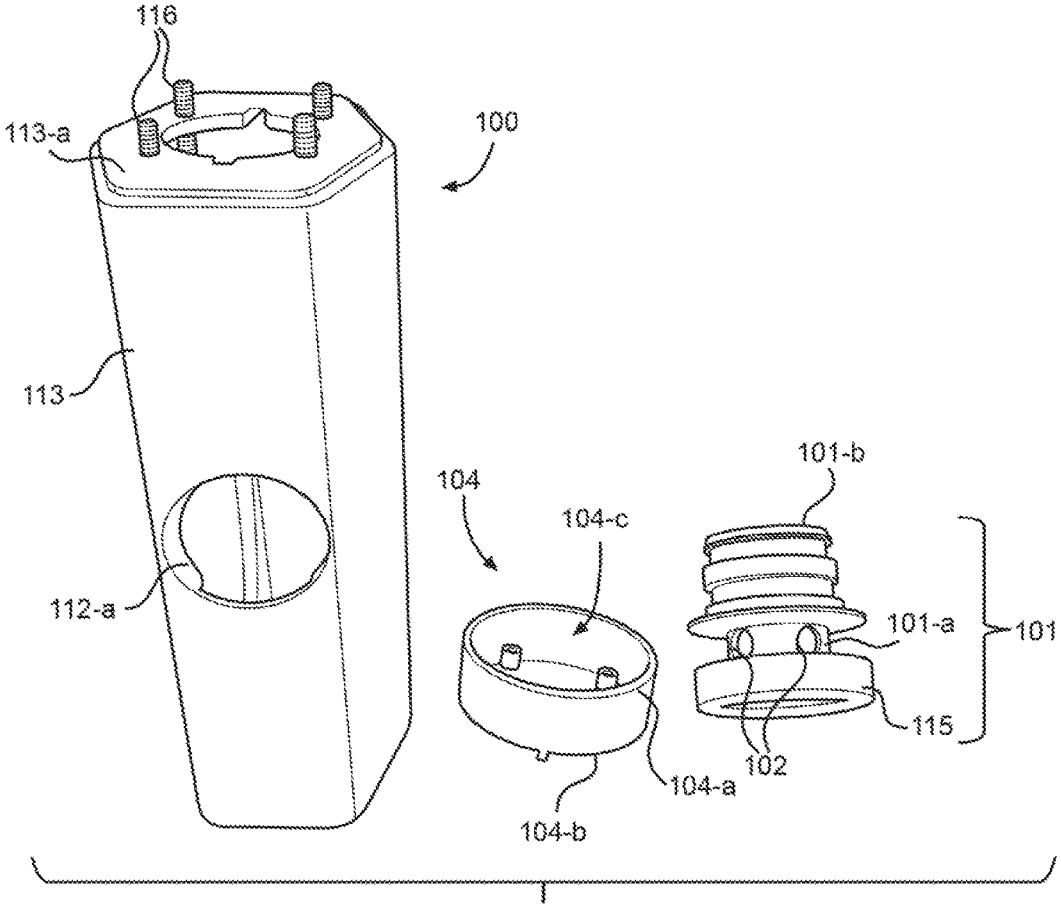
FIG. 1*b* shows the perspective view of the closed flame system of the lighter device in a disassembled state, according to an aspect.
Figure 1C:
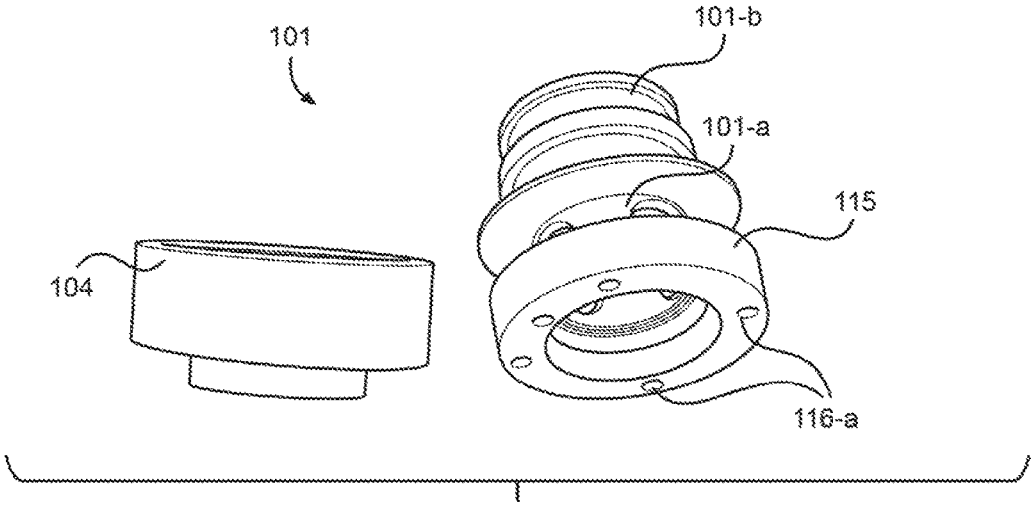
FIG. 1*c* shows a bottom perspective view of the closed flame system in a disassembled state, according to an aspect.

The lighter device 100 may also be provided with a closed flame system 101, having a base portion 115 ("base" or "base portion," as shown in FIGS. 1*b*-1*c*), an insulation portion 104, a neck portion 101-*a*, and an attachment portion 101-*b*. The attachment portion 101-*b* ("attachment portion" or "attachment") may include O-rings 103 on the outer surface which may, for example, be rubber, or any other suitable material, and may help to create a seal. The neck portion 101-*a* ("neck portion" or "neck") may be hollow and may include a plurality of holes 102, and may contain a flame within for heating or igniting smoke products, for example. The hollow neck portion 101-*a* may be in communication with the interior portion of the attachment portion 101-*b*. The hollow neck portion 101-*a* and the attachment portion 101-*b* may also be in communication with the base portion (as shown by 115 in FIGS. 1*b*-1*c*), and thus, the base portion, the neck portion, and the attachment portion may define a hollow interior space.

FIG. 1*b* shows the perspective view of the closed flame system 101 of the lighter device 100 in a disassembled state, according to an aspect. The butane flame that may be contained within the closed flame system 101 may become too hot for a user to comfortably hold, and thus, the lighter device 100 may also be provided with an insulation portion 104, which may be constructed from thick plastic, or any other suitable material, which may help to absorb some of the generated heat. An advantage may be that the device 100 may be more comfortable for the user to hold. The insulation portion 104 may have a top insulation end 104-*a* and a bottom insulation end 104-*b*, and may be configured to receive the base portion 115 into an interior insulation cavity 104-*c*. As shown, the base portion 115 may be associated with the attachment portion 101-*b* by the hollow neck portion 101-*a*, and air flow from the neck's plurality of holes 102 may be received into the inner cavity of the attachment portion 101-*b* ("inner cavity" or "interior attachment cavity"). The hollow neck portion 101-*a* may be configured to house and thus partially enclose a flame ignited by the torch. The plurality of holes 102 may allow air flow such that the partially enclosed flame may be supplied with and receive air and oxygen and thus be sustained and may not die out. Again, the base portion 115, the hollow neck portion 101-*a* and the attachment portion 101-*b* may be in communication and may define a hollow interior space, such that air flow may be received in the hollow interior space and heat from the flame in the neck portion 101-*a* may be supplied to the attachment portion 101-*b*. Thus, an advantage may be the that safety hazards of an open flame are reduced, by partially enclosing the flame while still supplying air to the flame through the plurality of holes 102.

The handle 113 may be provided with a button hole 112-*a*, which may be associated with a button. The bottom insulation end 104-*b* may be associated with the top handle end 113-*a*. Again, the interior insulation cavity 104-*c* may receive the base 115 of the closed flame system 101. The insulation portion 104 may be mounted or secured onto the top handle end 113-*a* by screws 116, or any other means for securing the pieces together. The lighter device 100 may rest on any surface on the bottom end ("bottom handle end") 113-*b* of the handle 113, which may be opposite of the top handle end 113-*a*.

FIG. 1*c* shows a bottom perspective view of the closed flame system 101 in a disassembled state, according to an aspect. The base portion 115 may include holes 116-*a* that may receive screws 116 (as shown in FIG. 1*b*), such that the closed flame system may be inserted into the insulation portion and mounted or secured to the handle 113 (as shown in FIG. 1*b*). As an example, screws 116 may be received through the insulation portion 104 and into the base 115. As shown, the base portion 115 may be hollow and the base portion 115, the hollow neck portion 101-*a*, and the inner cavity of the attachment portion 101-*b* may be in communication with each other.

Figure 1D:
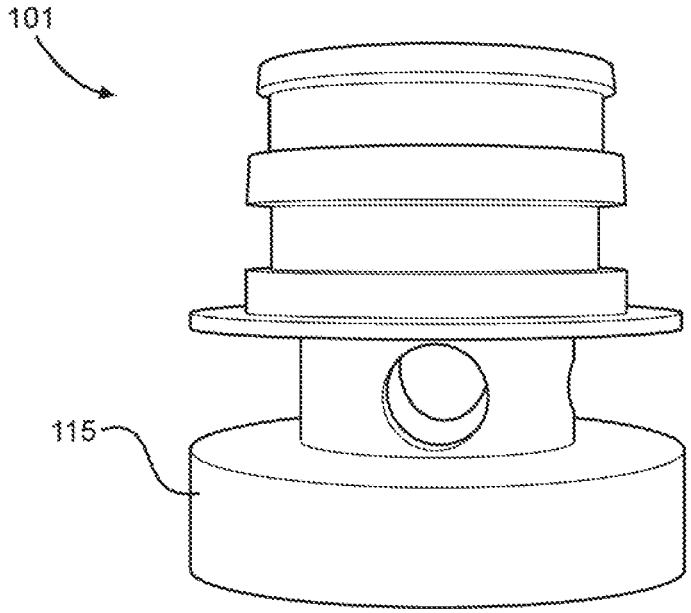
FIGS. 1*d*-1*e* show a side view and a side perspective view, respectively, of the closed flame system without the insulation portion, according to an aspect.
Figure 1E:
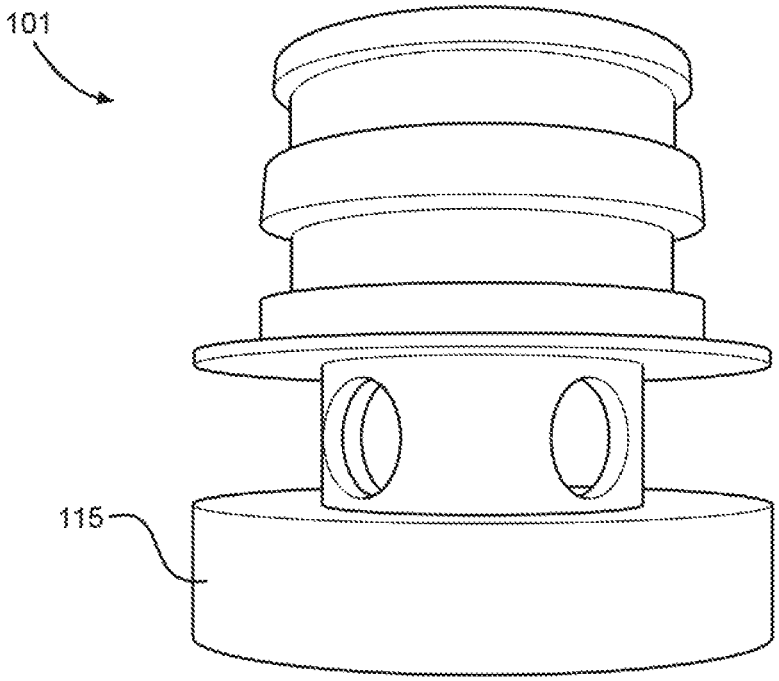

FIGS. 1*d*-1*e* show a side view and a side perspective view, respectively, of the closed flame system 101 without the insulation portion, according to an aspect. As shown, the attachment portion 101-*b* may be provided without O-rings (as shown in FIG. 1*a*). The base 115 of the closed flame system may be associated with the handle 113 through an insulation portion as shown in FIG. 1*a*, or may be associated directly with the handle 113.

Figures 2A, 2B:
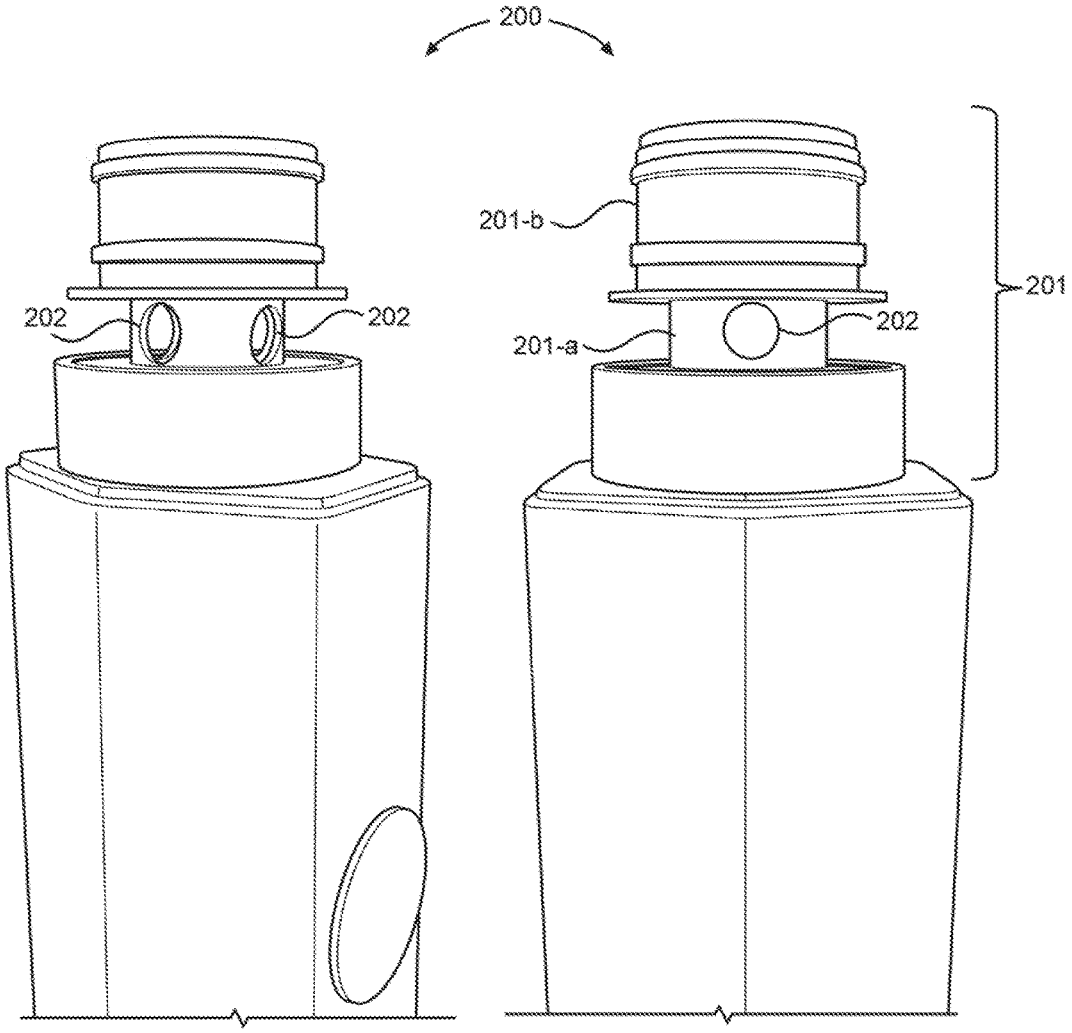
FIGS. 2*a*-2*c* show the side perspective view, side view, and another example of the side perspective view, respectively, of the closed flame system portion of the lighter device, according to an aspect.
Figure 2C:
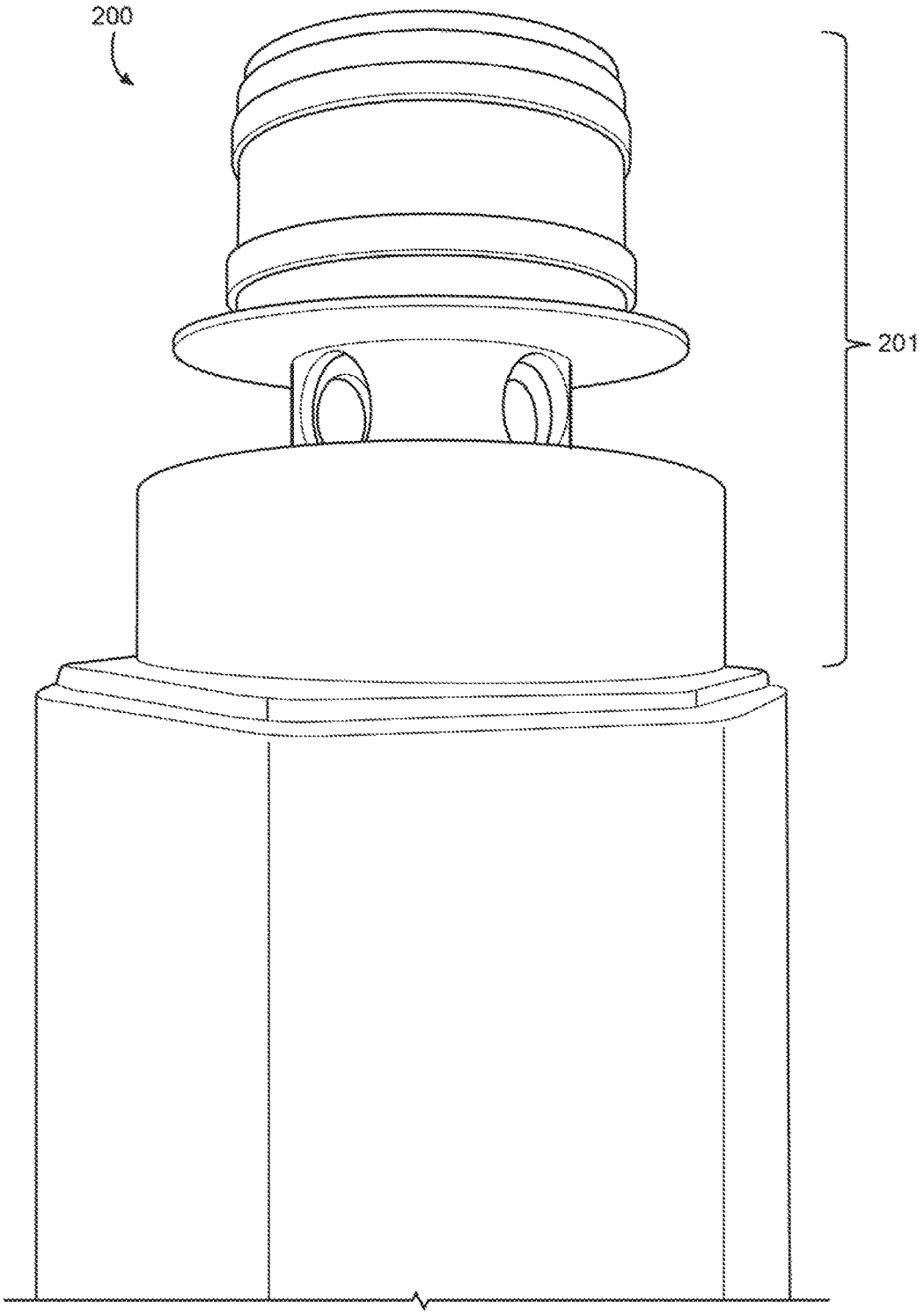

FIGS. 2*a*-2*c* show the side perspective view, side view, and another example of the side perspective view, respectively, of the closed flame system portion of the lighter device 200, according to an aspect. The neck portion 201-*a* of the closed flame system portion may include a plurality of holes 202. A flame may be ignited by the lighter and may be contained in the neck portion 201-*a*, using any suitable means for producing a spark, for example. As shown, the neck portion 201-*a* may be thinner than the attachment portion 201-*b*, and may hollow to house a flame and to receive air flow. The plurality of holes 202 may allow for some air flow into the neck portion 201-*a*, which may ensure that the flame within does not die out. The holes 202 may be of any suitable shape such as round as shown, or triangular, square, and so on. Thus, a flame that is partially covered or contained may be provided for a user, such that the safety hazards of an open flame may be reduced.

Figure 3A:
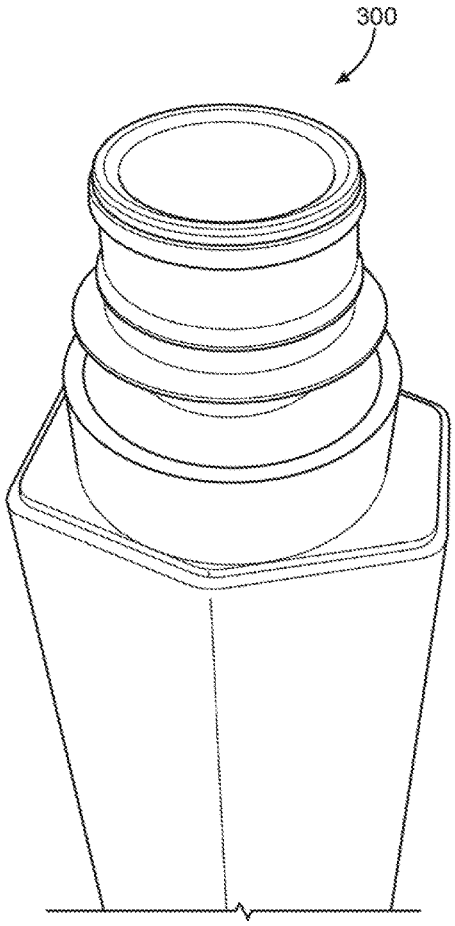
FIGS. 3*a*-3*b* show two examples of top perspective views of the closed flame system portion of the lighter device, according to an aspect.
Figure 3B:
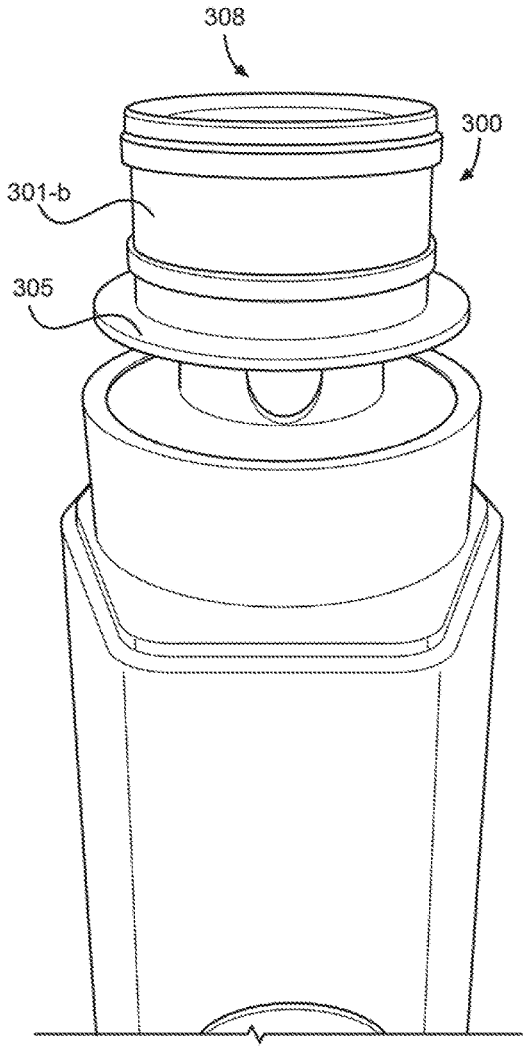
Figure 9:
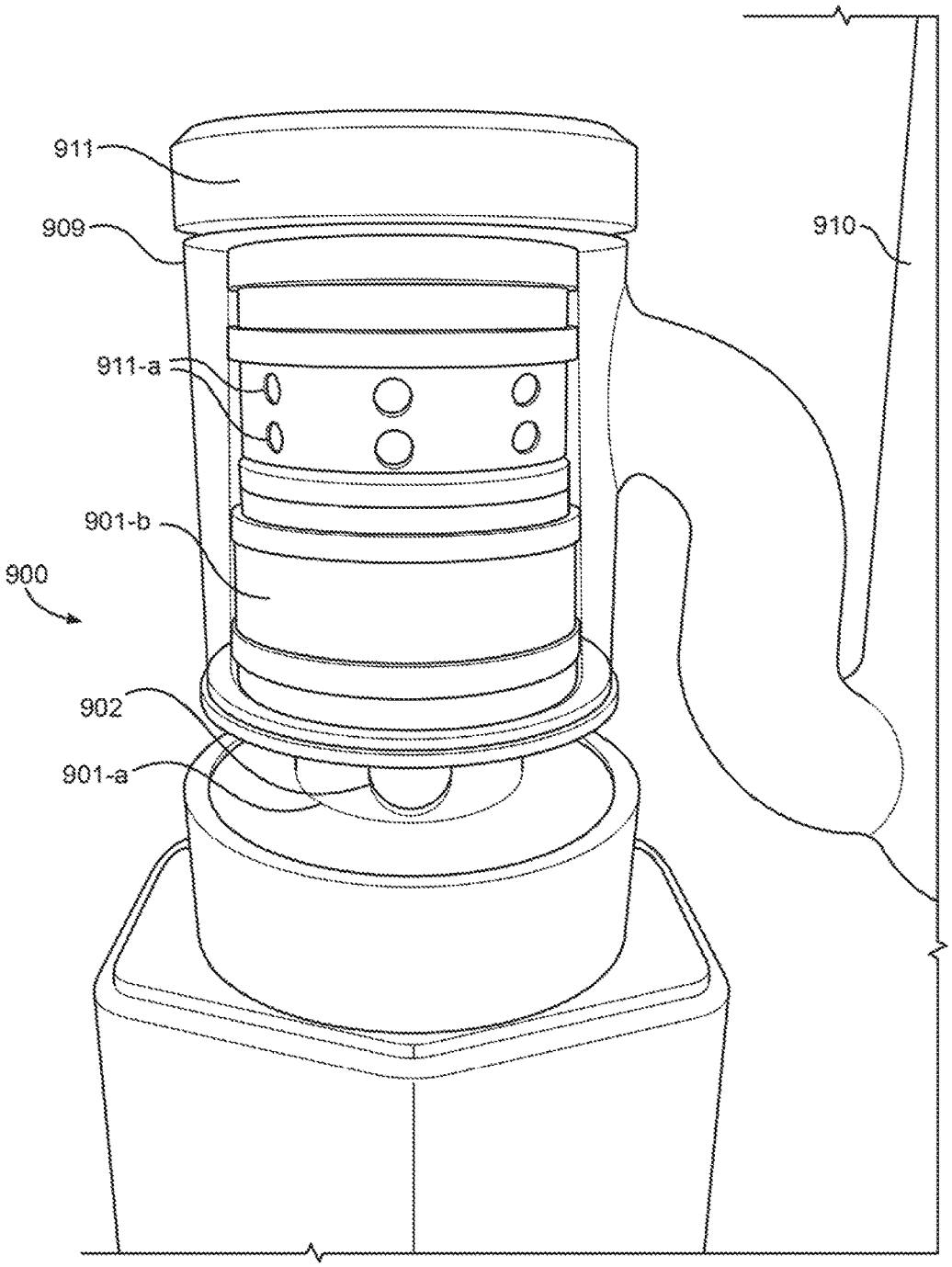
FIG. 9 shows a detailed side perspective view of the lighter device with a cup damper placed on the attachment portion, and a cap placed into the attachment portion, according to an aspect.

FIGS. 3*a*-3*b* show two examples of top perspective views of the closed flame system portion of the lighter device 300, according to an aspect. The attachment portion 301-*b* may have a top attachment end 308, and may include a rim 305 at the bottom end opposite to the top attachment end 308. The rim 305 may, for example, assist in holding a cup damper (as shown in FIG. 9), or any other piece that may fit over the attachment portion 301-*b*.

Figure 4A:
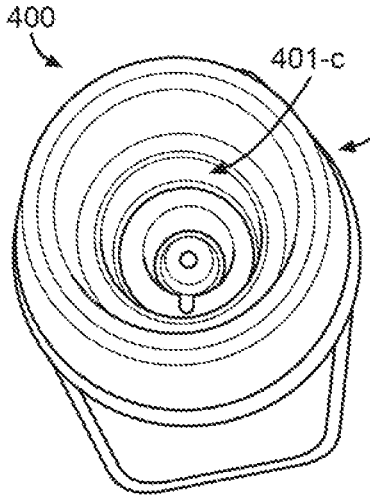
FIGS. 4*a*-4*b* show the top perspective view and the top view, respectively, of the lighter device, shown in an unlit state, according to an aspect.
Figure 4B:
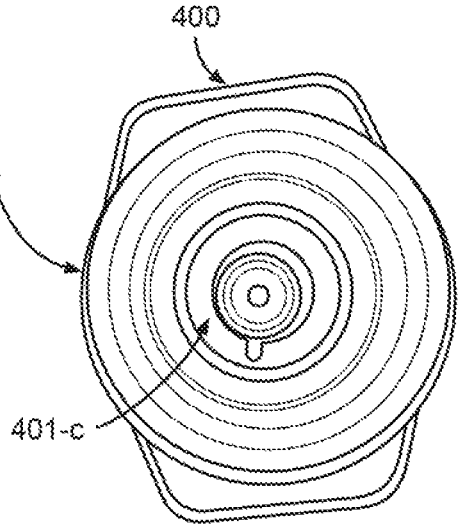

FIGS. 4*a*-4*b* show the top perspective view and the top view, respectively, of the lighter device 400, shown in an unlit state, according to an aspect. The attachment portion 401-*b* may be open and configured to receive an insert, for example. The attachment portion 401-*b* may be provided with an inner cavity 401-*c* into which an insert may be placed. The inner cavity 401-*c* may be configured to receive air flow from the neck portion underneath, for example.

Figure 4C:
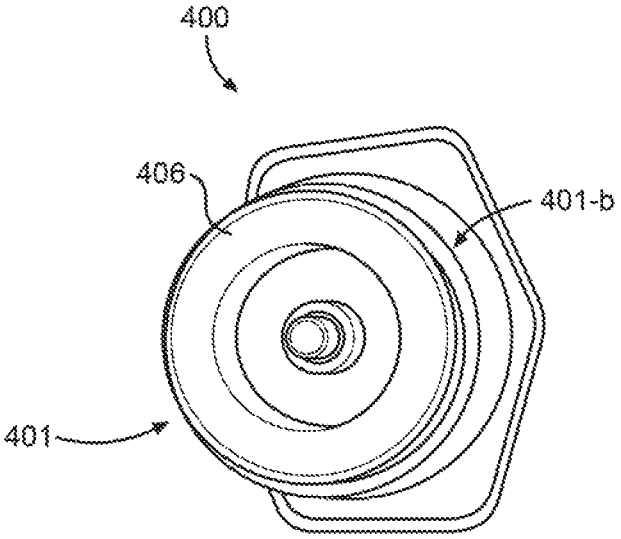
FIG. 4*c* shows the top perspective view of the lighter device with an insert, according to an aspect.

FIG. 4*c* shows the top perspective view of the lighter device 400 with an insert 406, according to an aspect. The attachment portion 401-*b* may be configured to receive an insert 406. The insert may, for example, be a cup or bowl 406, and may receive smoke products, such as, for example, marijuana or wax, and may be used for dry or wet or oil products. The cup 406 may be constructed from ceramic, titanium, quartz, or any other suitable material. As shown as an example, the cup 406 may be titanium or any other suitable metal. The closed flame system 401 may be configured such that the closed flame system is sealed on the top end when an insert such as a cup 406 is received into the attachment 401-*b*. The cup 406 and the attachment 401-*b* may be configured such that when the cup 406 and attachment 401 such that the closed flame system is closed from the top end.

Figure 4D:
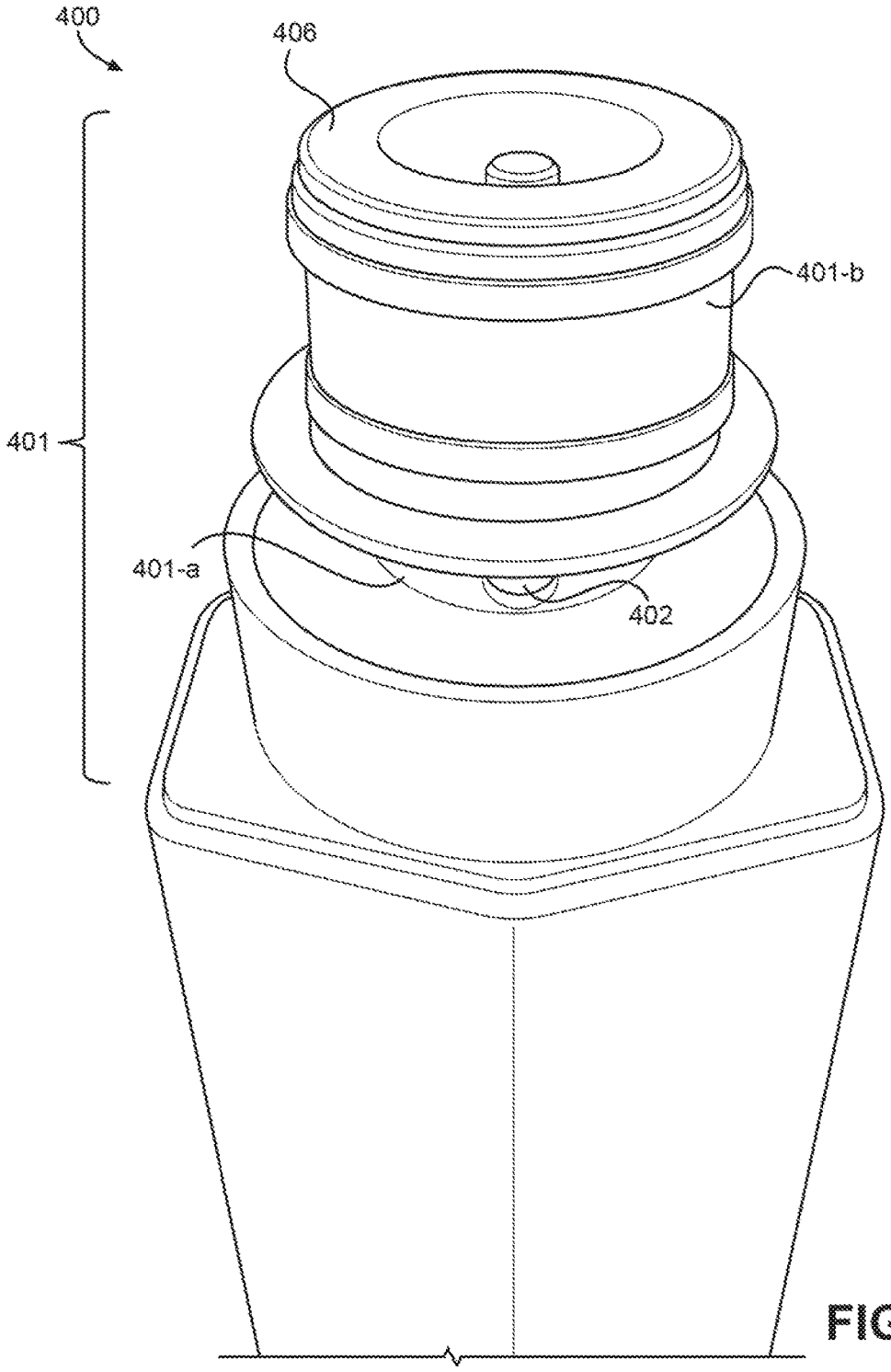
FIG. 4*d* shows the side perspective view of the lighter device with an insert in the attachment portion, according to an aspect.

FIG. 4*d* shows the side perspective view of the lighter device 400 with an insert 406 in the attachment portion 401-*b*, according to an aspect. Again, the closed flame system 401 may be closed from the top end. When sealed from the top end with an insert 406, the closed flame system 401 may still receive air flow from the holes 402 underneath, in the neck portion 401-*a*.

Figure 5A:
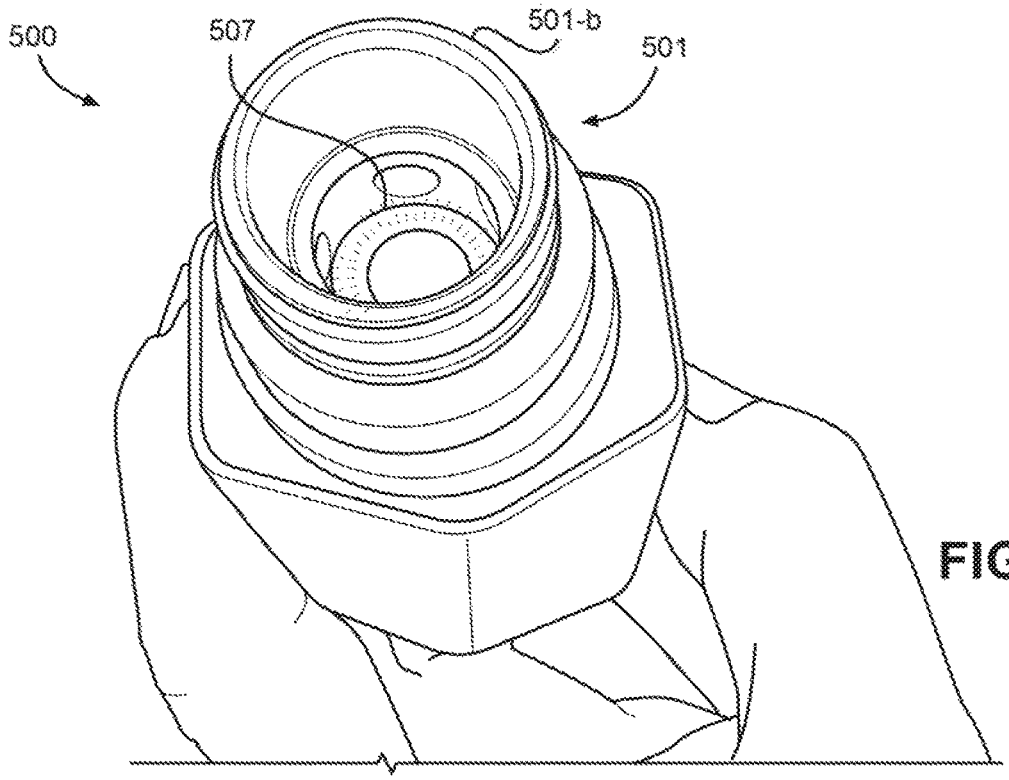
FIGS. 5*a*-5*c* show an example of the top perspective view, another example of the top perspective view, and a side perspective view, respectively, of the lighter device, shown in a lit state, according to an aspect.
Figure 5B:
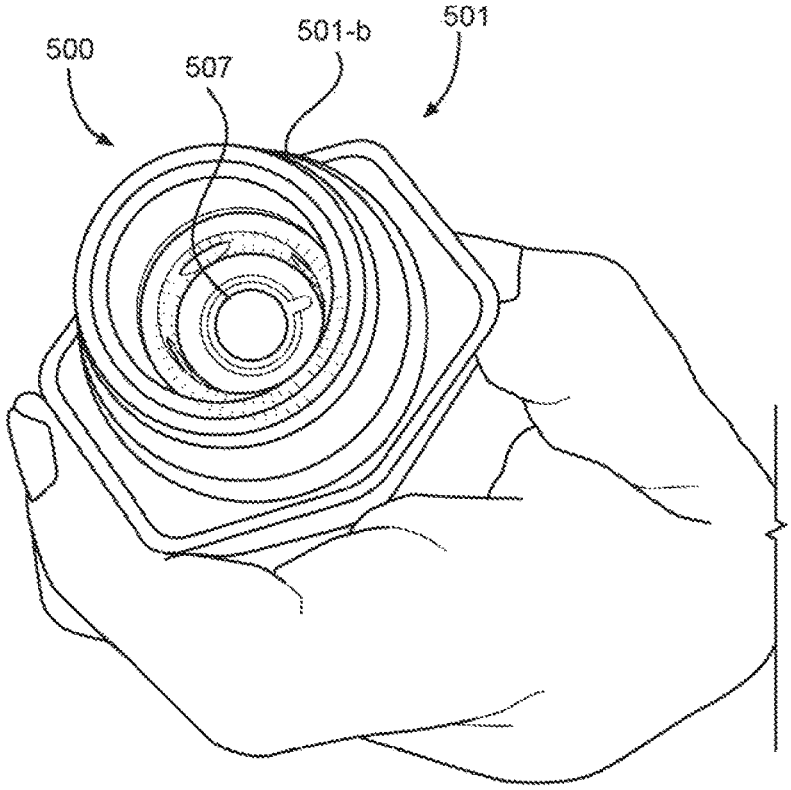
Figure 5C:
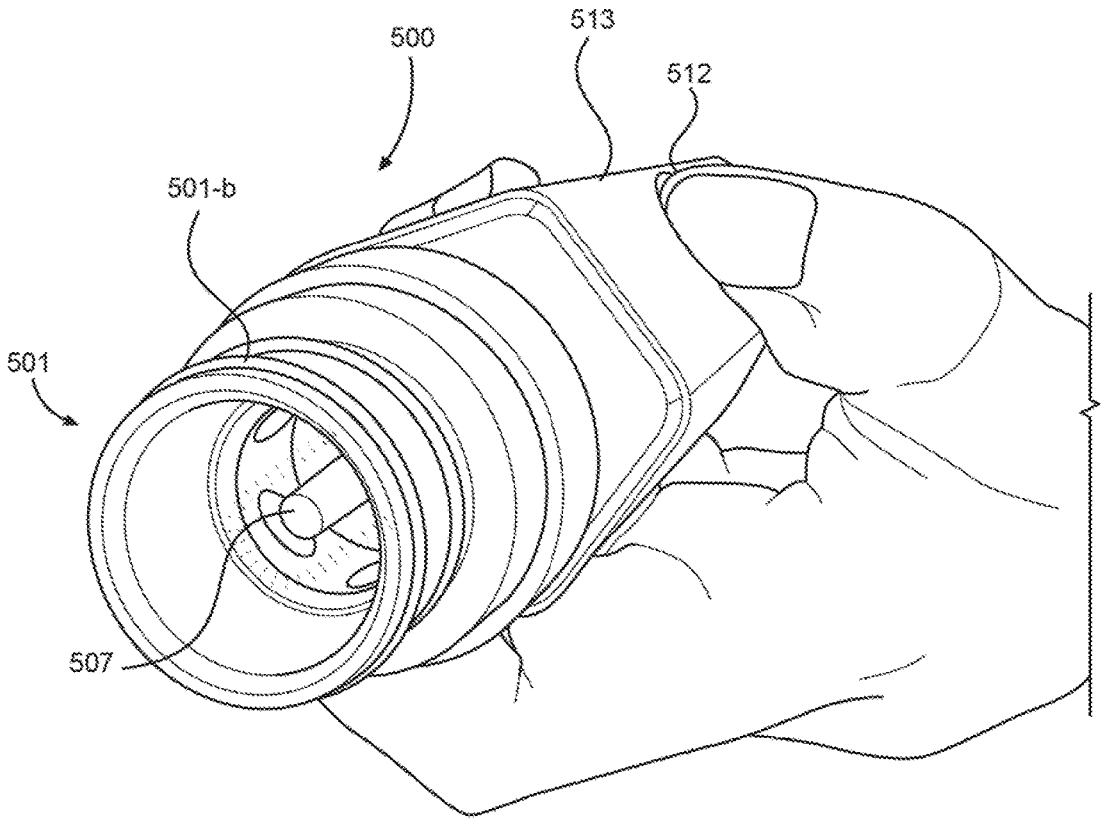

FIGS. 5*a*-5*c* show an example of the top perspective view, another example of the top perspective view, and a side perspective view, respectively, of the lighter device 500, shown in a lit state, according to an aspect. A flame 507 may be provided inside of the closed flame system 501, and may be visible inside of the attachment portion 501-*b* when no pieces are inserted into the attachment 501-*b*. The lighter device 500 may be provided with an ignition means, which, again, may be similar to an ignition means of a cigarette lighter for example, and the ignition means may be operated by any suitable ignition actuation means. The ignition actuation means may be for example a button, which may be integrated with the handle 513, as indicated by 512.

Figure 6A:
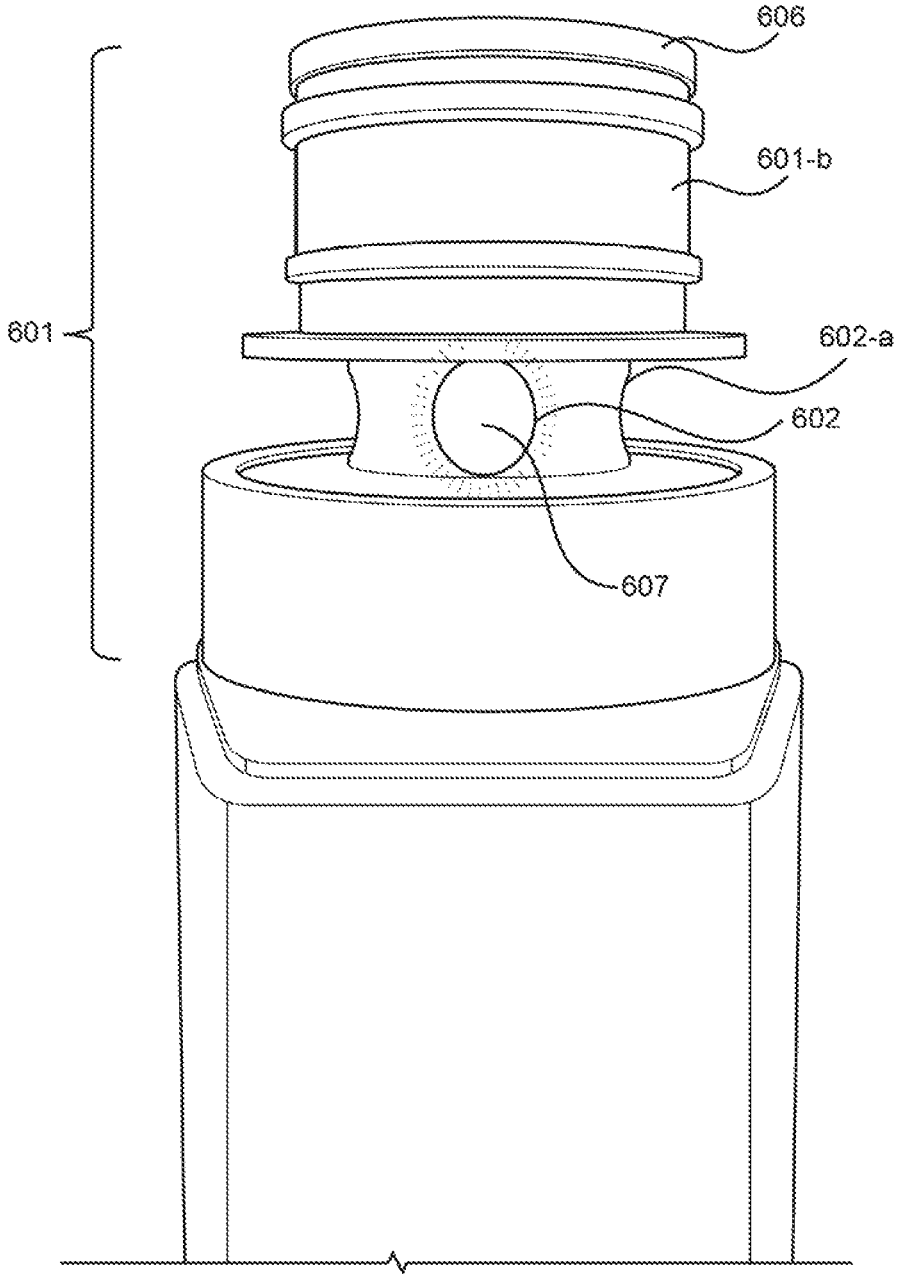
FIG. 6*a* shows the side view of the lighter device, shown in a lit state, according to an aspect.

FIG. 6*a* shows the side view of the lighter device 600, shown in a lit state, according to an aspect. A flame may be provided inside of the closed flame system 601, and the attachment piece 601-*b* may be fitted with a cup 606. The cup 606 may be constructed from ceramic, as shown as an example. When inserted into the attachment portion 601-*b*, the cup 606 may seal the closed flame system at the top end. The flame 607 may then still be sustained from air flow received from the holes 602.

Figure 6B:
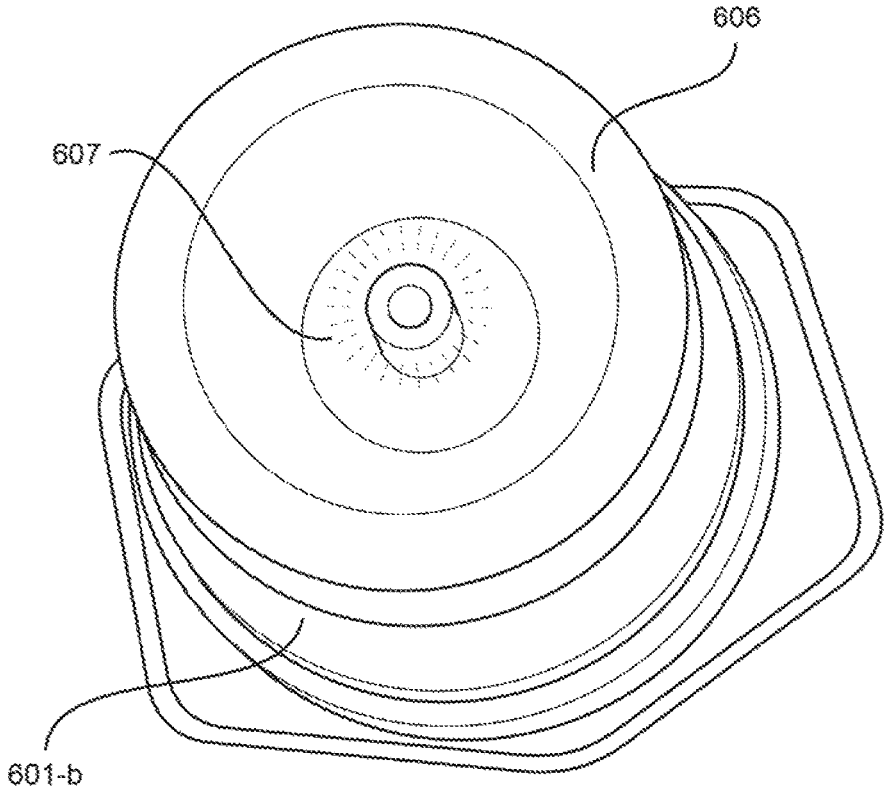
FIG. 6*b* shows the top perspective view of the lighter device, shown in a lit state, with a cup inserted, according to an aspect.

FIG. 6*b* shows the top perspective view of the lighter device 600, shown in a lit state, with a cup 606 inserted, according to an aspect. The top end of the attachment piece 601-*b* may be sealed by the insertion of the cup 606, and the glow of the flame 607 may be visible underneath the cup.

Figure 7A:
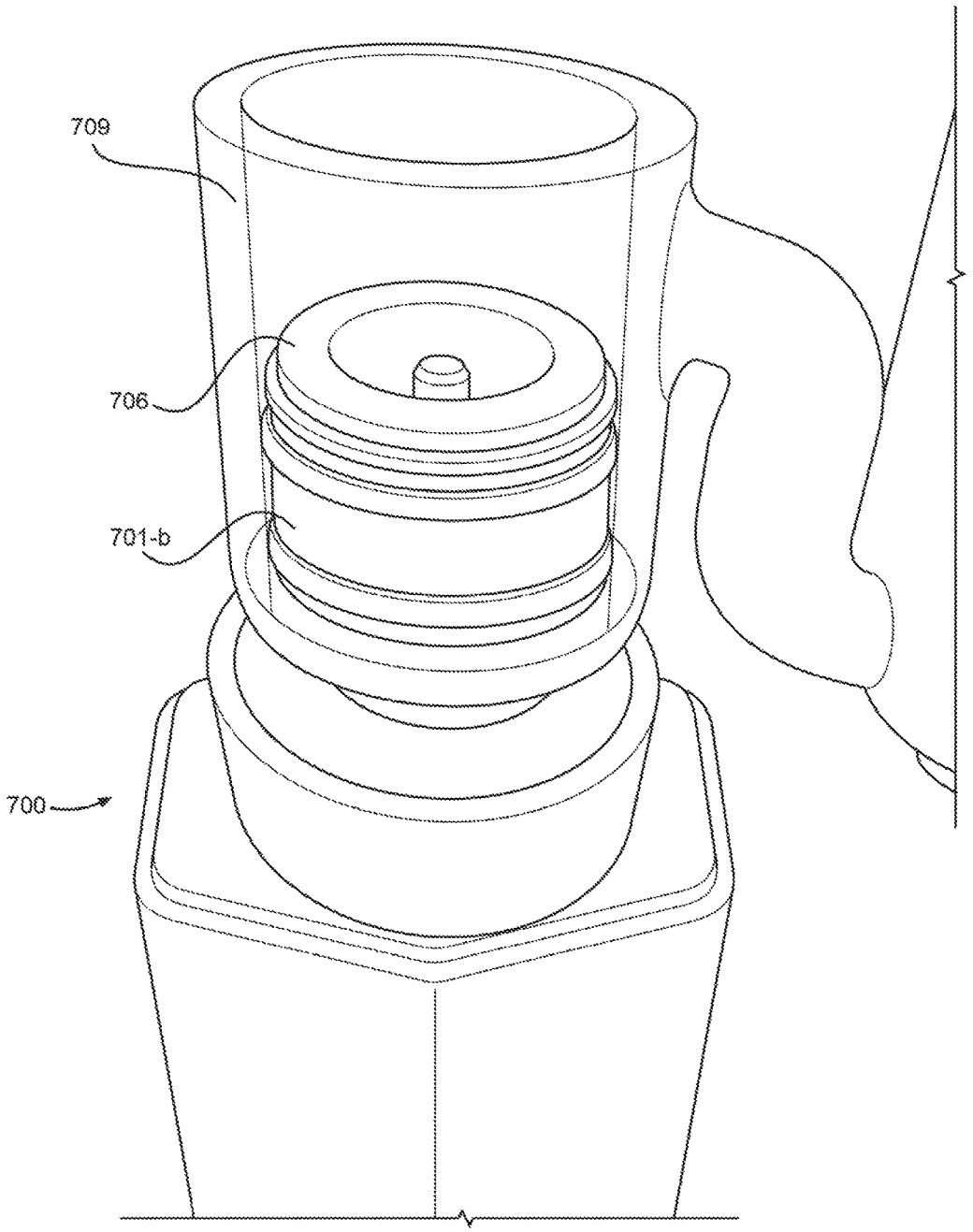
FIGS. 7*a*-7*b* show the side perspective view and the top perspective view, respectively, of the lighter device, with a cup inserted and a cup damper in place, according to an aspect.
Figure 7B:
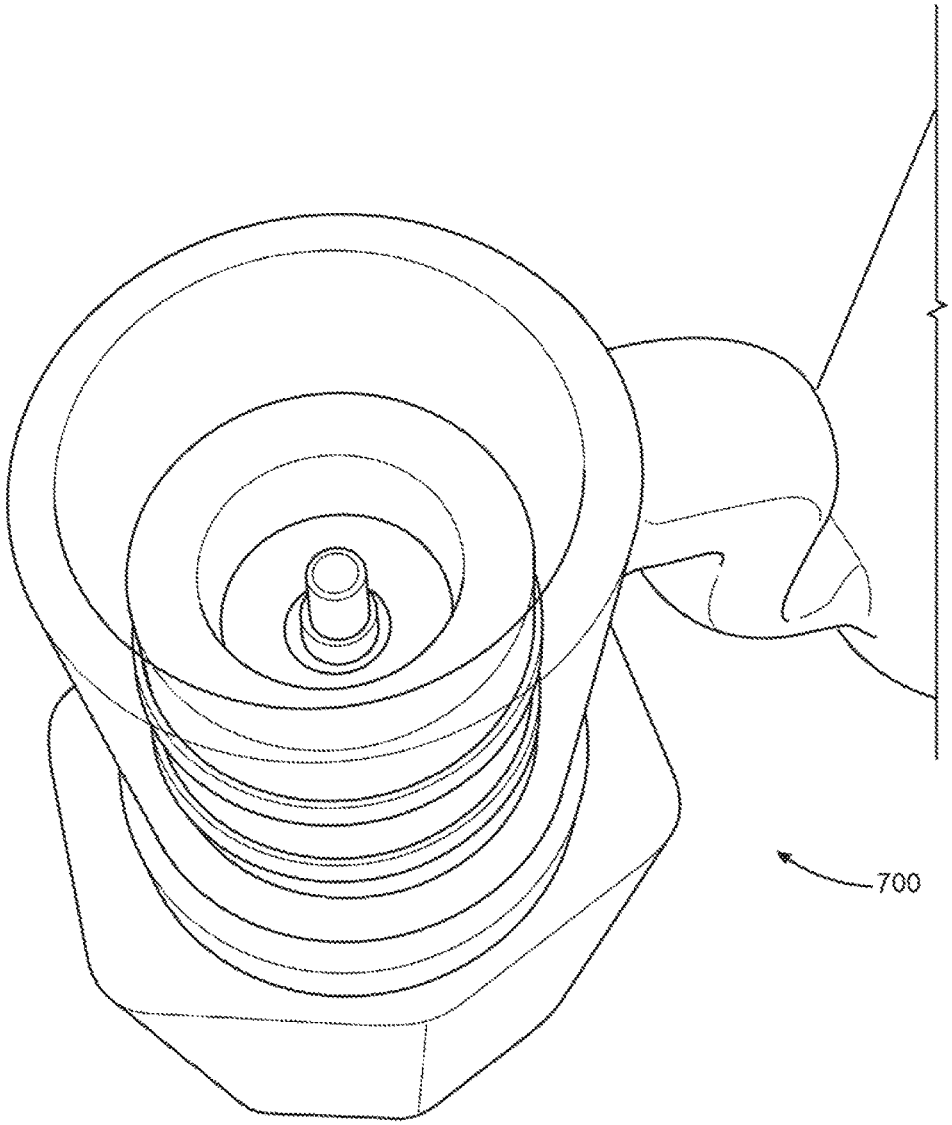

FIGS. 7*a*-7*b* show the side perspective view and the top perspective view, respectively, of the lighter device 700, with a cup 706 inserted and a cup damper 709 in place, according to an aspect. The cup damper may be glass, for example, or any other suitable material. As shown, a cup damper 709 may be placed over the attachment portion 701-*b*, and may rest or be held in place by a rim 705 (as shown in FIG. 7*c*).

Figure 7C:
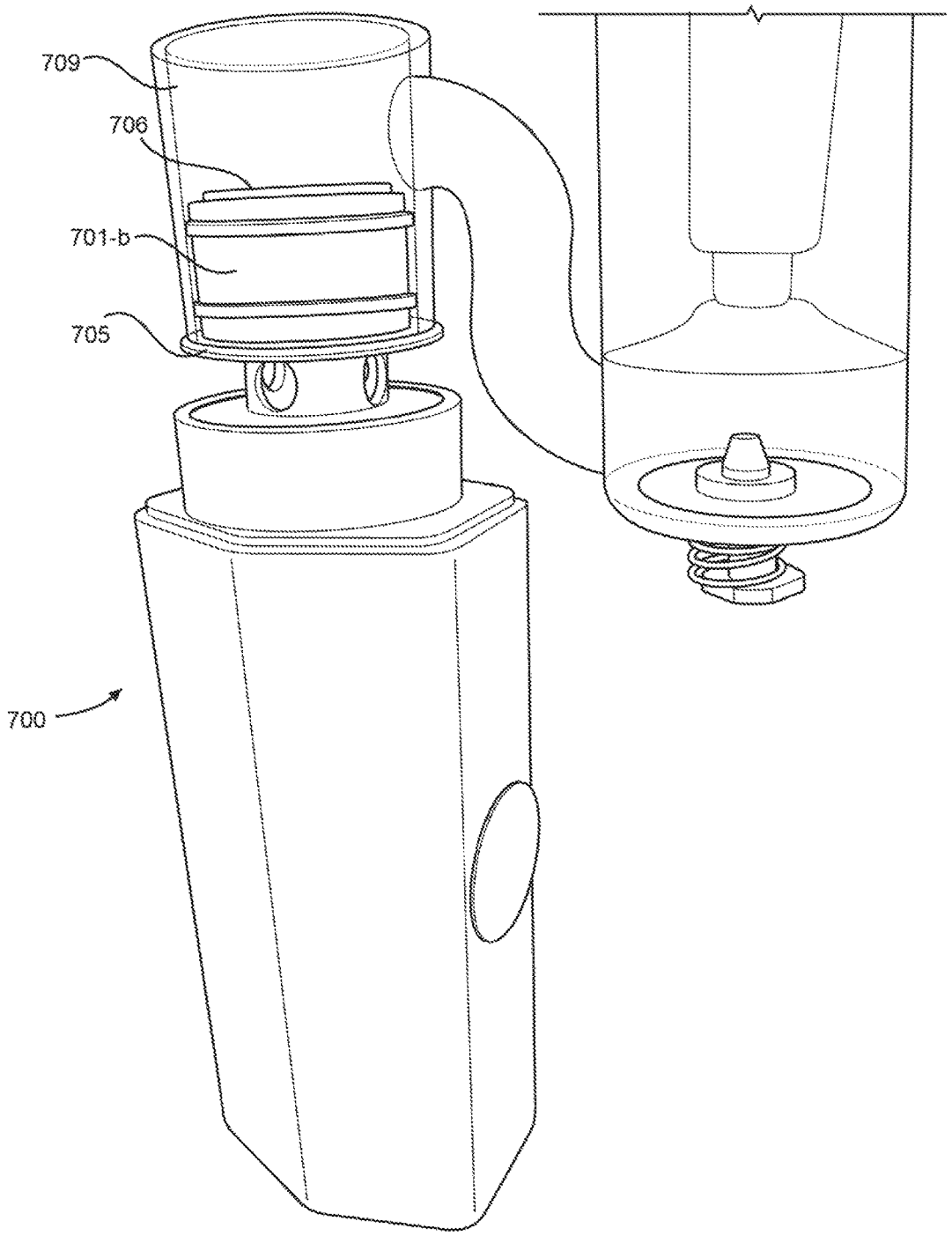
FIG. 7*c* shows the side perspective view of the lighter device 700 with a cup damper placed on the attachment portion, according to an aspect.

FIG. 7*c* shows the side perspective view of the lighter device 700 with a cup damper 709 placed on the attachment portion 701-*b*, according to an aspect. The cup damper 709 may then connect to a glass pipe 710, for example. Again, as shown, a cup damper 709 may be placed over the attachment portion 701-*b*, and may rest or be held in place by a rim 705.

Figure 8A:
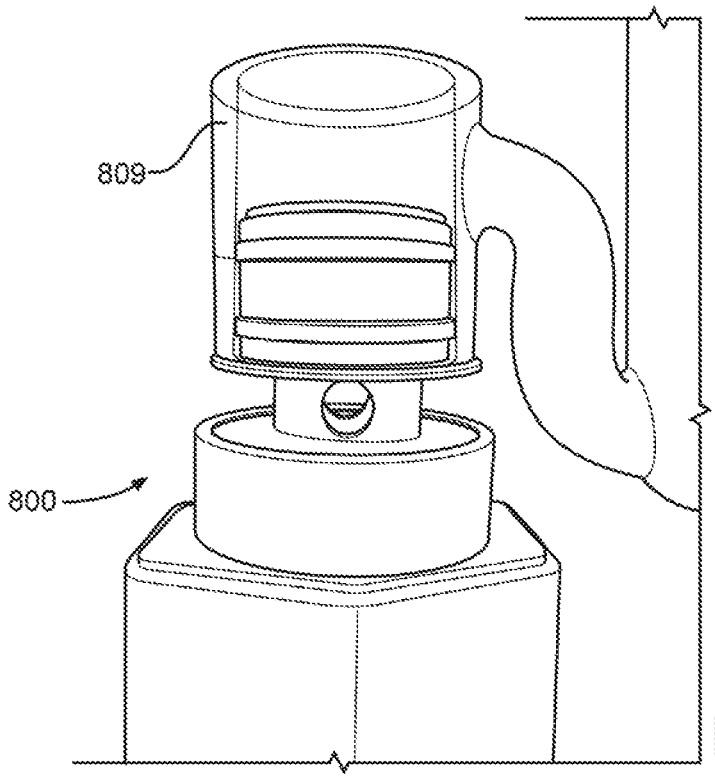
FIGS. 8*a*-8*b* show the side perspective views of the lighter device with a cup damper placed on the attachment portion, without a cap and with a cap, respectively, according to an aspect.
Figure 8B:
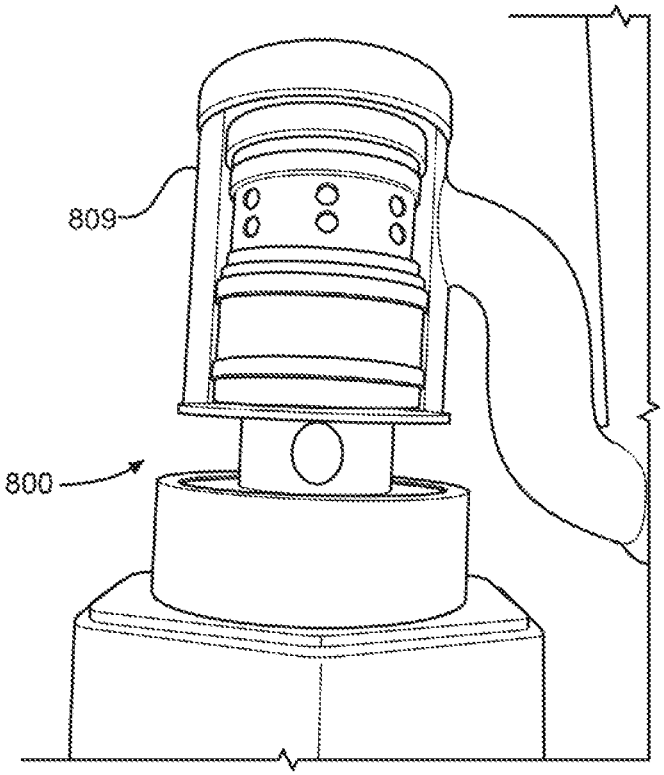

FIGS. 8*a*-8*b* show the side perspective views of the lighter device 800 with a cup damper placed on the attachment portion, without a cap and with a cap 811, respectively, according to an aspect. The cup damper may be open at the top damper end 809-*a*, such that another piece such as a cap 811 may be placed into it and into the attachment portion 801-*b*. When a cup damper and cap 811 are in place, the closed flame system may be sealed on the top end, and may still receive air flow from the holes 802 below, in the neck portion 801-*a*.

FIG. 9 shows a detailed side perspective view of the lighter device 900 with a cup damper placed on the attachment portion, and a cap 911 placed into the attachment portion 901-*b*, according to an aspect. The cap may be magnetic, for example, to assist in holding a seal on the attachment portion 901-*b*. The cap 911 may also include holes 911-*a*, which may allow smoke from the attachment portion 901-*b* to flow into the glass pipe 910. Again, when the attachment portion 901-*b* is sealed from the top end, the flame inside of the closed flame system may still be sustained by air flowing in from the holes 902 of the hollow neck portion 901-*a*.

FIG. 10*a* shows the front view of the lighter device 1000 without a decorative element on the button 1012, according to an aspect. Again, the ignition means for the lighter device 1000 may be a button 1012 as shown. The button 1012 may be integrated with the handle 1013 by a screw 1018, for example.

FIG. 10*b* shows the front view of the lighter device 1000 with the button 1012 removed, showing a fuel tank 1017 inside of the handle 1013, according to an aspect. As shown, the fuel tank 1017 of the torch may be integrated with the handle 1013. Again, the button 1012 may be attached to the handle 1013 by a screw 1018 or any other suitable means, and may also be removed as shown.

FIG. 11 shows the front view of the fuel tank 1117 removed from the lighter device 1100, according to an aspect. As an example, the fuel tank 1117 may be removable such that it may be replaced when empty. The fuel tank may for example provide butane for the lighter device 1100, and may be shaped such that the torch flame is contained within the closed flame system 1101.

Figure 12A:
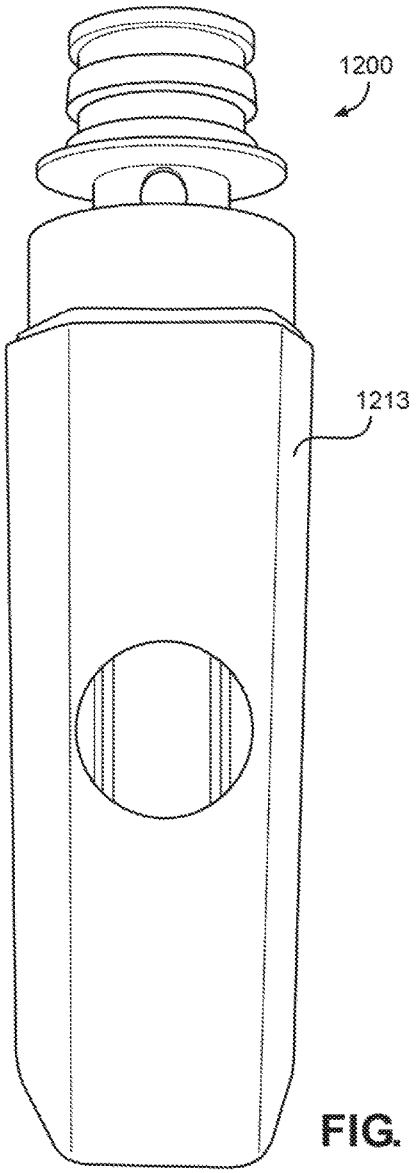
FIGS. 12*a*-12*b* show the front view and the bottom perspective view, respectively, of the lighter device without a fuel tank, according to an aspect.
Figure 12B:
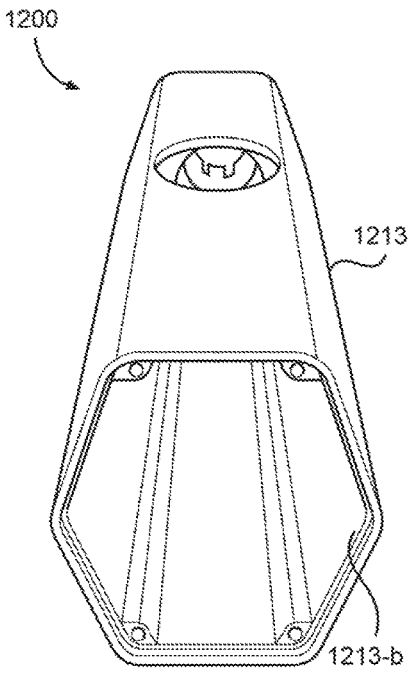

FIGS. 12*a*-12*b* show the front view and the bottom perspective view, respectively, of the lighter device 1200 without a fuel tank, according to an aspect. As an example, the handle 1213 may be hollow and the bottom may be removed as shown, at the bottom handle end 1213-*b* to allow a fuel tank to be integrated within.

Figure 13A:
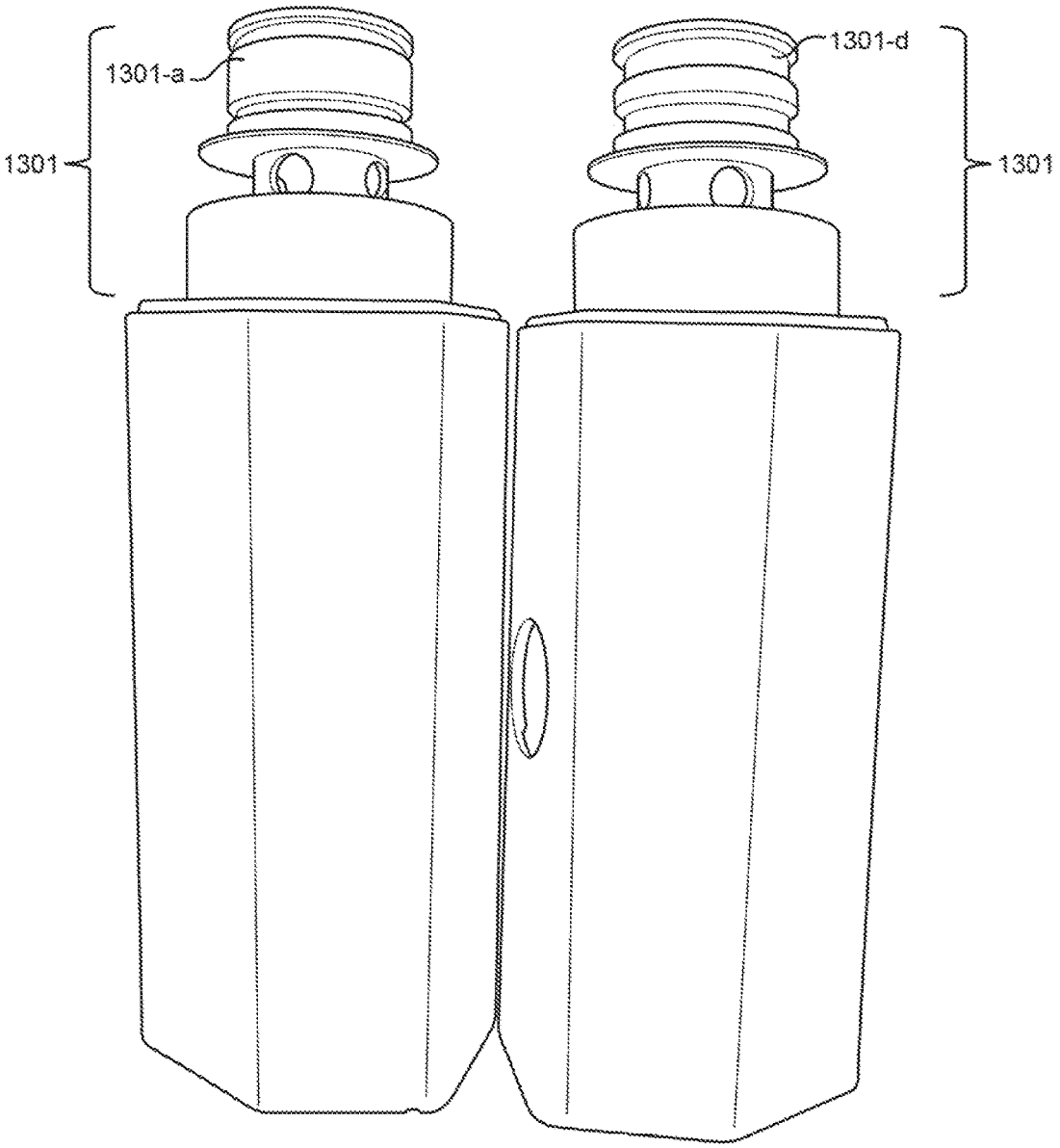
FIG. 13*a* shows a front view of two examples of the closed flame system, according to an aspect.

FIG. 13*a* shows a front view of two examples of the closed flame system 1301, according to an aspect. The closed flame system 1301 may include a straight attachment portion 1301-*a* or a tapered attachment portion 1301-*d*.

Figure 13B:
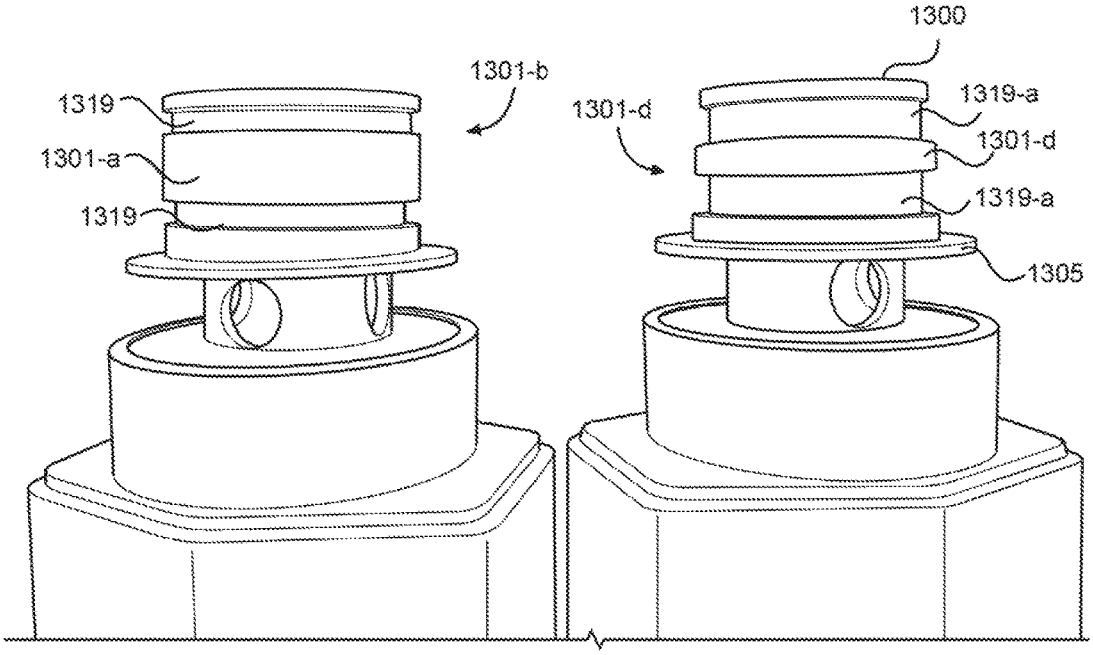
FIG. 13*b* shows an enlarged detailed view of the examples of FIG. 13*a*, according to an aspect.

FIG. 13*b* shows an enlarged detailed view of the examples of FIG. 13*a*, according to an aspect. As an example, the attachment portion 1301-*b* of the closed flame system 1301 may be straight, and may include grooves 1319 for receiving O-rings. The closed flame system may also be provided with a tapered attachment portion 1301-*d*. The tapered attachment portion 1301-*d* may be wider at the rim 1305 than at the top attachment end 1308.

p attachment end 13 An advantage may be that the tapered shape may assist the user in attaching a cup damper (as shown in FIG. 9) more easily, and may reduce damage to the cup damper. The tapered attachment portion 1301-*d* may also include grooves 1319-*a* for receiving O-rings, and may be a larger size than grooves 1319 of the straight attachment portion 1301-*b*.

Figure 13C:
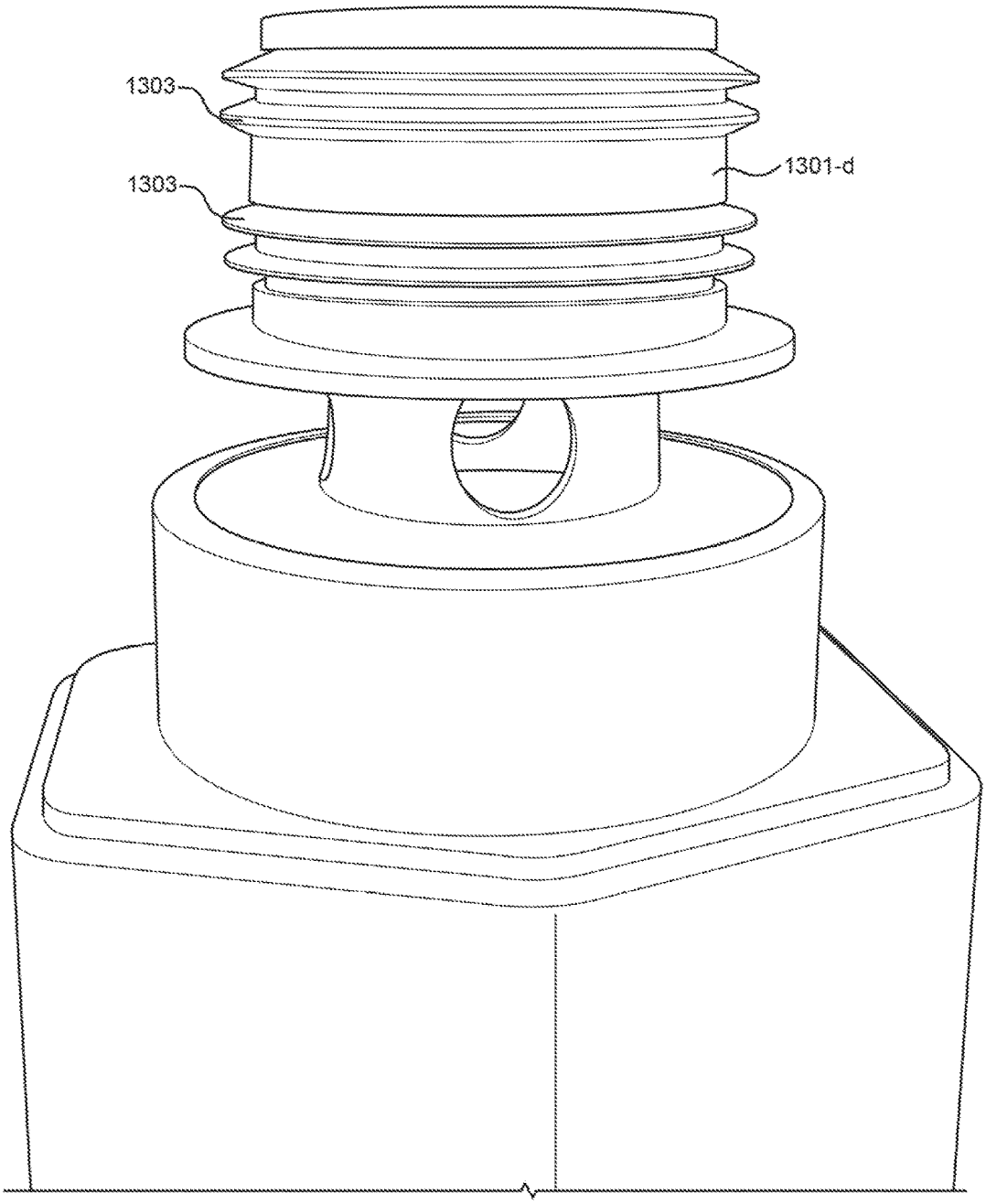
FIG. 13*c* shows an example of O-rings used with a tapered attachment portion, according to an aspect.

FIG. 13*c* shows an example of O-rings 1303 used with a tapered attachment portion 1301-*d*, according to an aspect. The grooves of the attachment portion may receive O-rings 1303 of any suitable shape, for example, and may help create a seal or suction hold with a cup damper (as shown in FIG. 9) or any other suitable accessory.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/ or examples. Hence, the scope of the invention is defined by the accompanying claims and their equivalents. Further, each and every claim is incorporated as further disclosure into the specification.

What is claimed is:

1. A lighter device comprising a torch integrated within a handle having a top handle end and a bottom handle end, the torch comprising a fuel tank, an ignition means, and an ignition actuating means; the lighter device further comprising a closed flame system having a base portion associated with the top handle end, a neck portion having a plurality of holes and configured to house and partially enclose a flame ignited by the torch, and an attachment portion having a plurality of grooves for receiving O-rings; the base portion, the neck portion and the attachment portion being in communication and defining a hollow interior space, and thus supplying air flow to the flame by allowing the air flow into the hollow interior space from the plurality of holes.

2. The lighter device of claim 1, wherein the neck portion is thinner than the attachment portion.

3. The lighter device of claim 1, wherein the base portion, the neck portion, and the attachment portion are constructed from metal.

4. The lighter device of claim 1, wherein the attachment portion having an exterior surface and an interior attachment cavity further comprises a rim around the exterior surface.

5. The lighter device of claim 4, wherein the attachment portion is configured to receive an insert placed into the interior attachment cavity.

6. The lighter device of claim 1, further comprising a flame control knob.

7. The lighter device of claim 1, wherein the ignition actuating means is a button.

8. The lighter device of claim 1, wherein the bottom handle end is removable.

9. A lighter device comprising a torch integrated within a handle having a top handle end and a bottom handle end, the torch comprising a fuel tank, an ignition means, and an ignition actuating means; the lighter device further comprising a closed flame system having a base portion associated with the top handle end, a neck portion having a plurality of holes and configured to house and partially enclose a flame ignited by the torch, an attachment portion having a plurality of grooves for receiving O-rings, and insulation portion having an interior insulation cavity configured to receive the base portion, the base portion and the insulation portion being configured to be mounted to the top handle end; and the base portion, the neck portion and the attachment portion being in communication and defining a hollow interior space, and thus supplying air flow to the flame by allowing the air flow into the hollow interior space from the plurality of holes.

10. The lighter device of claim 9, wherein the neck portion is thinner than the attachment portion.

11. The lighter device of claim 9, wherein the base portion, the neck portion, and the attachment portion are constructed from metal.

12. The lighter device of claim 9, wherein the attachment portion having an exterior surface and an interior attachment cavity further comprises a rim around the exterior surface.

13. The lighter device of claim 12, wherein the attachment portion is configured to receive an insert placed into the interior attachment cavity.

14. A closed flame system for housing and partially enclosing a flame, comprising a base portion, a neck portion having a plurality of holes, and an attachment portion having a plurality of grooves for receiving O-rings; the neck portion and the attachment portion being in communication and defining a hollow interior space, and thus supplying air flow to the flame by allowing the air flow into the hollow interior space from the plurality of holes.

15. The closed flame system of claim 14, further comprising an insulation portion having an interior insulation cavity configured to receive the base portion.

16. The closed flame system of claim 15, wherein the base portion and the insulation portion are configured to be mounted to a lighter device.

17. The lighter device of claim 9, wherein the insulation portion is constructed from plastic.

* * * * *